US011078709B2

(12) United States Patent
Meoni

(10) Patent No.: US 11,078,709 B2
(45) Date of Patent: Aug. 3, 2021

(54) CLOSURE APPARATUS FOR OPENINGS FOR ACCESS TO INDUSTRIAL MACHINES

(71) Applicant: I.M.A. INDUSTRIA MACCHINE AUTOMATICHE S.P.A IN SIGLA IMA S.P.A., Ozzano Dell'Emilia (IT)

(72) Inventor: Eddi Meoni, Ozzano Dell'Emilia (IT)

(73) Assignee: I.M.A. INDUSTRIA MACCHINE AUTOMATICHE S.P.A. IN SIGLA IMA S.P.A., Ozzano Dell'Emilia (IT)

( * ) Notice: Subject to any disclaimer, the term of this patent is extended or adjusted under 35 U.S.C. 154(b) by 232 days.

(21) Appl. No.: 16/081,353

(22) PCT Filed: Feb. 27, 2017

(86) PCT No.: PCT/EP2017/054499
§ 371 (c)(1),
(2) Date: Aug. 30, 2018

(87) PCT Pub. No.: WO2017/148859
PCT Pub. Date: Sep. 8, 2017

(65) Prior Publication Data

US 2019/0093414 A1 Mar. 28, 2019

(30) Foreign Application Priority Data

Mar. 1, 2016 (IT) ..... 102016000021524

(51) Int. Cl.
*E05F 15/665* (2015.01)
*B65B 3/00* (2006.01)
(Continued)

(52) U.S. Cl.
CPC ..... *E05F 15/665* (2015.01); *B65B 3/003* (2013.01); *B65B 55/025* (2013.01); *B65B 55/04* (2013.01);
(Continued)

(58) Field of Classification Search
CPC ..... E05F 15/665; E05F 15/686; E05F 15/684; E05F 15/681; E05Y 2201/644;
(Continued)

(56) References Cited

U.S. PATENT DOCUMENTS 1,827,433 A 10/1931 Kendall
3,529,650 A * 9/1970 Brancato ..... E06B 9/70 160/133
(Continued)

FOREIGN PATENT DOCUMENTS

CN 2679324 Y 2/2005
CN 204386334 U 6/2015
(Continued)

OTHER PUBLICATIONS

International Search Report dated Apr. 11, 2017 re: Application No. PCT/EP2017/054499, pp. 1-3, citing: DE 10 2010 021121 A1, US 1 827 433A and US 2003/051410 A1.
(Continued)

*Primary Examiner* — Hemant Desai
*Assistant Examiner* — Christopher Robin Kim
(74) *Attorney, Agent, or Firm* — Cantor Colburn LLP

(57) ABSTRACT

A closure apparatus for openings for access to industrial machines includes a door which can move, by virtue of the action of a respective actuator which includes a motorized shaft which supports at least two mutually opposite pulleys for winding flexible elements connected to respective substantially upper and external portions of the door. The actuator includes substantially at an intermediate section of the shaft, at least one third idle pulley for winding at least one third flexible element connected to a substantially upper and central portion of the door. The third pulley is provided with at least one position sensor for detecting an unrolling of the third flexible element.

12 Claims, 4 Drawing Sheets

(51) Int. Cl.
*B65B 55/02* (2006.01)
*B65B 55/04* (2006.01)

(52) U.S. Cl.
CPC ... *E05Y 2201/658* (2013.01); *E05Y 2201/664* (2013.01); *E05Y 2201/686* (2013.01); *E05Y 2400/44* (2013.01); *E05Y 2600/10* (2013.01); *E05Y 2900/608* (2013.01)

(58) Field of Classification Search
CPC ..... E05Y 2201/664; E05Y 2600/10; E05Y 2201/658; E05Y 2900/608; E05Y 2201/686; E05Y 2400/44; B65B 3/003; B65B 55/025; B65B 55/04
USPC ..... 53/426, 167; 49/199
See application file for complete search history.

(56) References Cited

U.S. PATENT DOCUMENTS 4,727,919 A * 3/1988 Kraeutler ..... E06B 9/0692 160/84.02
4,828,003 A * 5/1989 Kraeutler ..... E06B 9/70 160/84.02
5,170,829 A * 12/1992 Duncan ..... B65G 1/02 160/194
6,481,156 B1 * 11/2002 Richmond ..... A01K 1/0017 49/24
6,860,311 B1 * 3/2005 Minor ..... E05D 15/18 160/193
9,022,079 B2 * 5/2015 Py ..... B65B 55/025 141/11
2003/0051410 A1 * 3/2003 Cloutier ..... G09F 7/20 49/322
2006/0086065 A1 * 4/2006 Tomalesky ..... B67C 3/007 53/425
2007/0000622 A1 * 1/2007 Reed ..... E05F 15/40 160/188
2010/0005760 A1 * 1/2010 Matheyka ..... B65B 55/08 53/426
2010/0122493 A1 * 5/2010 Burrows ..... E05D 13/1207 49/358
2012/0125543 A1 * 5/2012 Chambers ..... E06B 9/307 160/5
2015/0013226 A1 * 1/2015 Artwohl ..... E05F 15/668 49/25
2015/0203222 A1 * 7/2015 Zonato ..... B65B 25/001 53/455
2015/0316915 A1 * 11/2015 Balder ..... E05F 15/668 700/275
2017/0009507 A1 * 1/2017 Newman ..... E05F 15/665
2020/0115946 A1 * 4/2020 Hudson ..... E05F 15/40

FOREIGN PATENT DOCUMENTS

DE 202006013143 U1 11/2006
DE 102010021121 A1 11/2011
EP 2933165 A1 10/2015
FR 2822887 A1 10/2002

OTHER PUBLICATIONS

Written Opinion dated Apr. 11, 2017 re: Application No. PCT/EP2017/054499, pp. 1-5, citing: DE 10 2010 021121 A1, US 1 827 433A and US 2003/051410 A1.

* cited by examiner

CLOSURE APPARATUS FOR OPENINGS FOR ACCESS TO INDUSTRIAL MACHINES

TECHNICAL FIELD

The present disclosure relates to a closure apparatus for openings for access to industrial machines.

BACKGROUND

In some devices, particularly suitable for the sterilization and/or depyrogenation of containers (for example bottles, syringes, vials, carpules and the like), the need often arises to prevent communication between the inside and the outside of the device, for example between a sterilization tunnel and a filling station.

For example, if it is necessary to perform an operation for sterilizing an internal compartment of the device (within which the containers will be conveyed), it is essential that the compartment be completely isolated from the outside environment, so as to avoid potential contaminations that might occur during sterilization or after it.

It is known to resort to sliding shutters which are suitable to close an access/exit opening of a station that is intended for sterilization when the need arises to segregate its internal volume (for example during or after sterilization operations).

One of the main problems of these shutters resides in the risk that, during the closure translation, they undergo misalignments, causing their lower edge not to match up with the lower threshold of the opening, preventing correct and complete closure. Obviously, the presence of passage ports or gaps between the lower edge of the shutter and the lower threshold of the opening causes the possibility of entry of particles, dust (therefore also potentially of bacteria, microorganisms or spores) which can compromise the sterility of the internal cavity.

More specifically, the most important technical problem that is inherent in the background art is linked to the substantial impossibility to have assured information on the actual position assumed by the door. Knowledge of the position of the door is extremely important for the correct operation of the machines that it separates and for their operational association, and this occurs regardless of whether blocking the door may prevent correct and complete closure.

It is in fact sometimes necessary to check and verify positions of the door that do not provide for any abutment between the door and a fixed locator (therefore, for example, intermediate positions that allow the arrangement of components for the coupling of the two machines).

It is possible to insert contact sensors (merely to detect an "abutment" on a locator) which provide evidence of contact between the lower edge of the shutter and the lower threshold of the opening. However, these sensors are subjected to the extremely high temperatures generated for the sterilization of the containers and/or of the internal cavity and therefore undergo a high thermal stress which can damage them in a short time.

On the other hand, the adoption of sensors suitable to operate at high temperatures entails a great increase in costs, since these are complex components that have a limited diffusion.

SUMMARY

The aim of the present disclosure is to solve the problems described above, by providing a closure apparatus for openings for access to industrial machines that allows to check the correct arrangement of the door with respect to predefined configurations of interest in application.

Within this aim, the disclosure proposes a closure apparatus for openings for access to industrial machines that ensures complete closure of the opening.

The disclosure also proposes a closure apparatus for openings for access to industrial machines that is suitable to tolerate extremely high operating temperatures.

The disclosure further proposes a closure apparatus for openings for access to industrial machines of a type and with an operating mode which are substantially different from those of closure apparatuses of the known type.

The present disclosure also provides a closure apparatus for openings for access to industrial machines that has modest costs, is relatively simple to provide in practice and is safe in application.

This aim and these and other advantages which will become better apparent hereinafter are achieved by providing a closure apparatus for openings for access to industrial machines according to claim 1.

BRIEF DESCRIPTION OF THE DRAWINGS

Further characteristics and advantages of the disclosure will become better apparent from the description of a preferred but not exclusive embodiment of the closure apparatus for openings for access to industrial machines according to the disclosure, illustrated by way of nonlimiting example in the accompanying drawings, wherein.

DETAILED DESCRIPTION OF THE DRAWINGS

Figure 1:
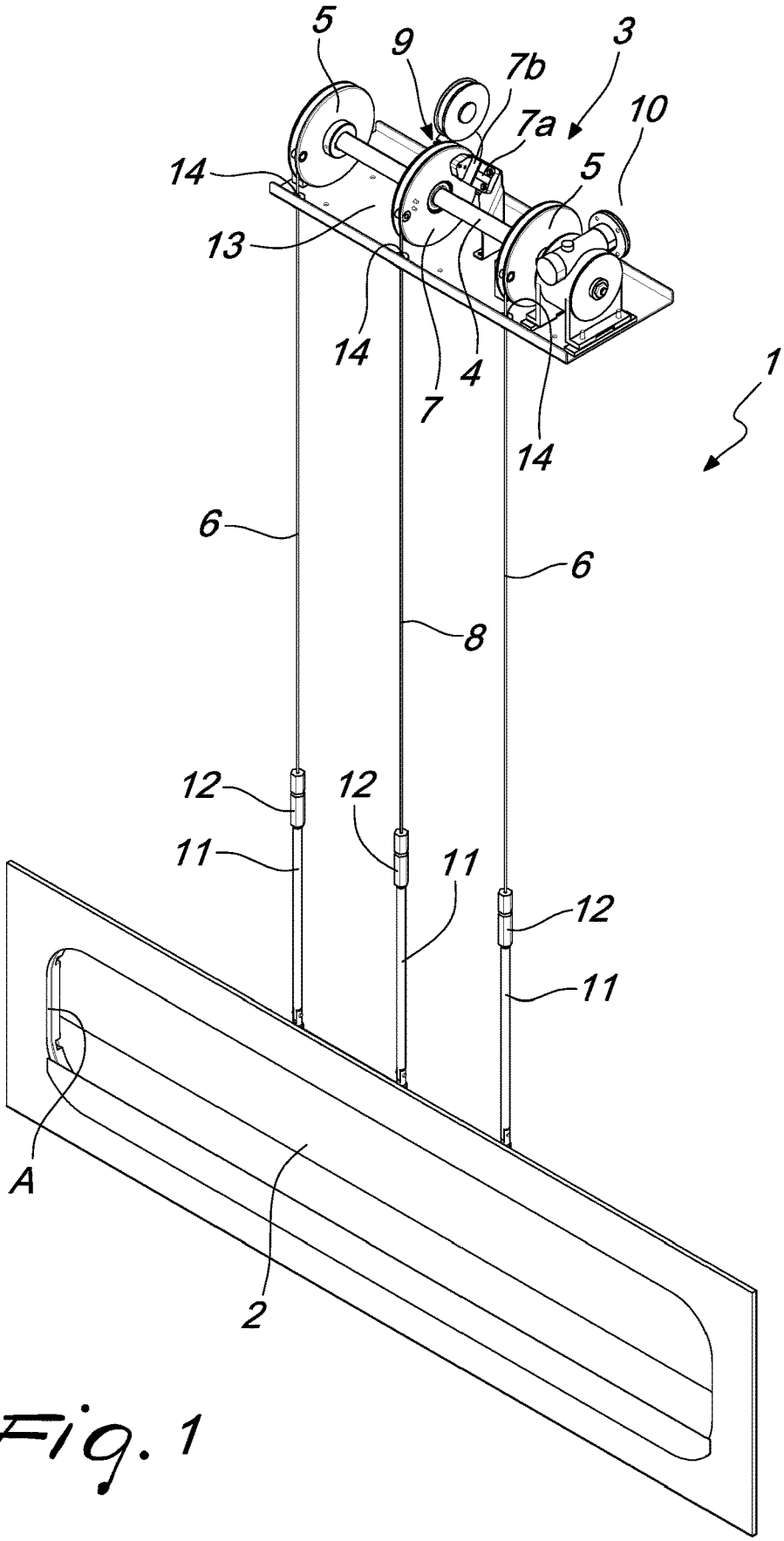
FIG. 1 is a perspective view of a closure apparatus according to the disclosure and of the respective opening for access to an industrial machine.
Figure 2:
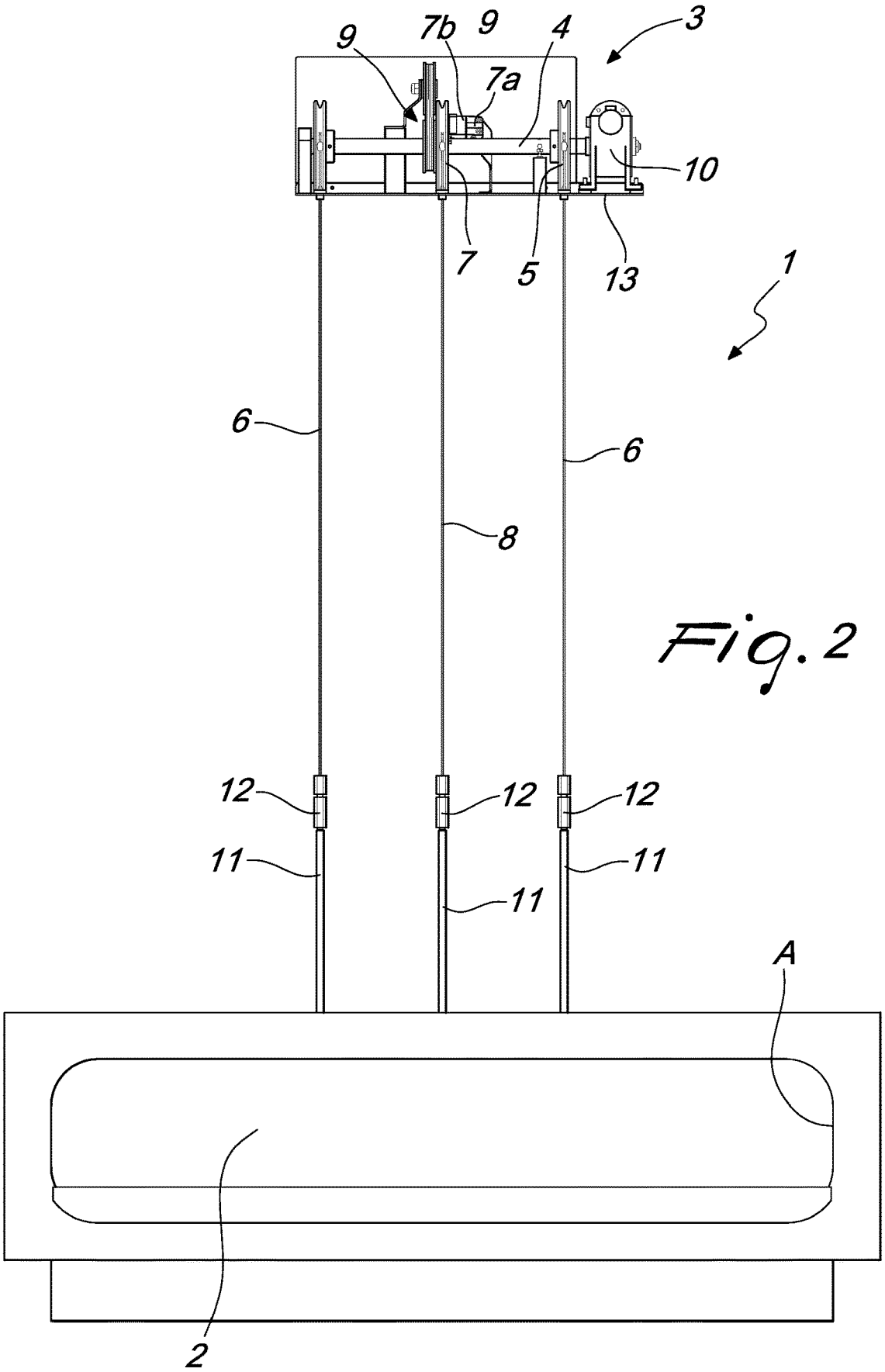
FIG. 2 is a front view of the apparatus of FIG. 1 and of the respective access opening.
Figure 3:
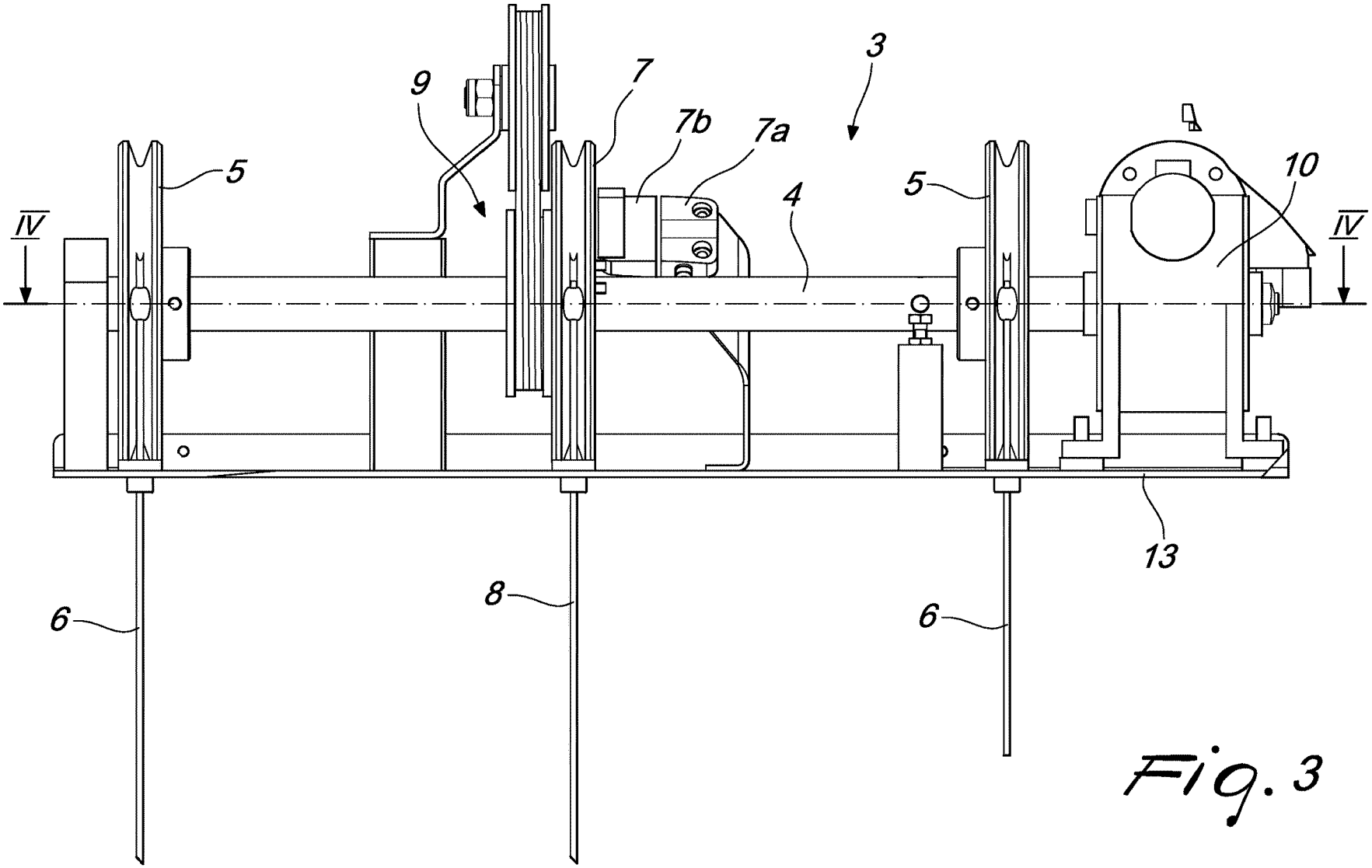
FIG. 3 is a front view of an enlarged-scale detail of FIG. 2.
Figure 4:
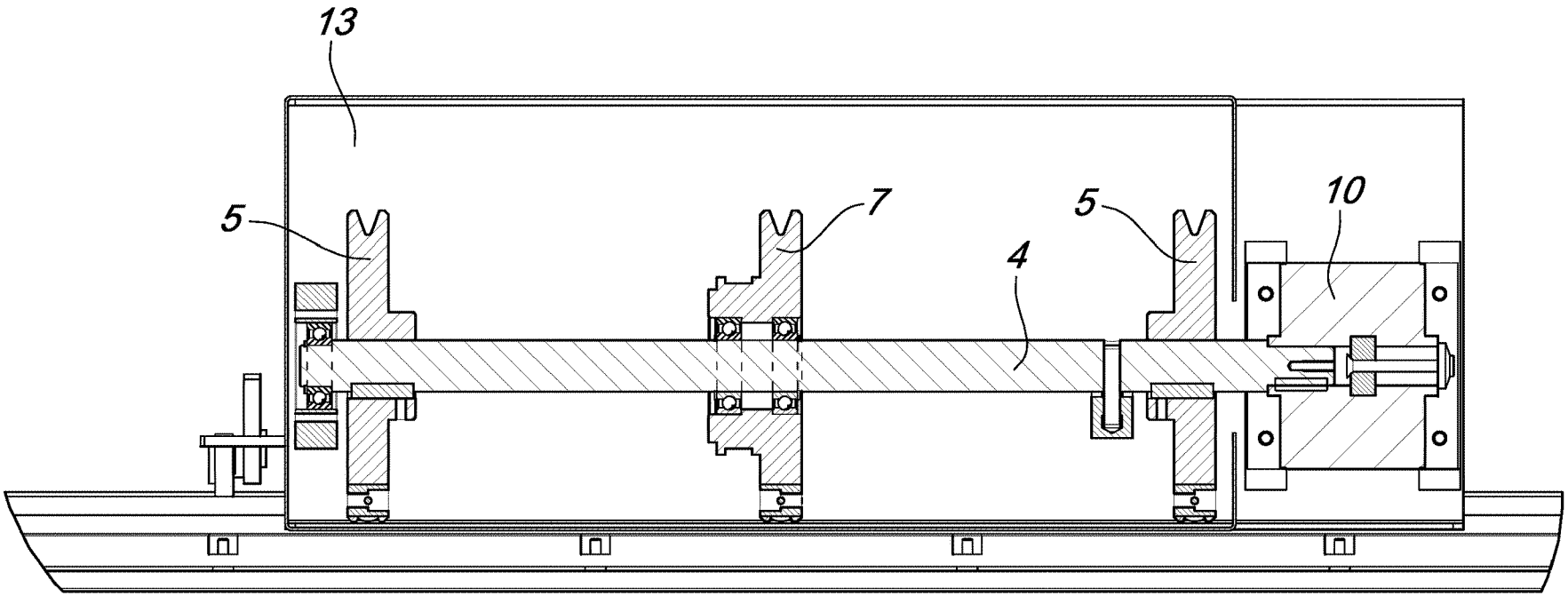
FIG. 4 is a sectional view, taken along the line IV-IV shown in FIG. 3.

With reference to FIGS. 1-4, the reference numeral 1 generally designates a closure apparatus for openings A for access to industrial machines.

Advantageously, the closure apparatus 1 can be applied to an access opening A which connects a sterilization tunnel adapted to sterilize containers and a filling station adapted to fill said containers with a product, which is preferably pharmaceutical.

The apparatus 1 comprises a movable door 2 and an actuator 3 that is adapted to move the door 2 between an active position for partial or total closure of the opening A and an inactive position for noninterference with the opening A, at which the door 2 is substantially raised with respect to the opening A.

The actuator 3 comprises a motorized shaft 4 which supports, at its ends, at least two mutually opposite pulleys 5.

The apparatus 1 further comprises first and second flexible elements 6, which are connected to respective substantially upper and external portions of the door 2. The pulleys 5 are preset to wind the first and second flexible elements 6.

Validly, the actuator 3 further comprises, substantially at an intermediate section of the shaft 4, at least one third idle pulley 7.

The apparatus 1 comprises a third flexible element 8, which is integral with a substantially upper and central portion of the door 2. The third idle pulley 7 is adapted to wind the third flexible element 8.

The third pulley 7 is provided with at least one position sensor 7*a*, 7*b* for detecting an unwinding of the third flexible element 8 that corresponds to a closure of the opening A on the part of the door 2.

In practice, once it has been verified (by the position sensor 7*a*, 7*b*) that the third flexible element 8 has unwound from the respective idle pulley 7 by a preset amount (an unwinding which is matched by the door in the active position, for example with the lower edge of the door 2 aligned with the lower threshold of the opening A), one is in fact certain that the door 2 is in the active position, for example that the opening A is completely and correctly closed.

Once the pulleys 5 have unwound the respective first and second flexible elements 6 by an amount that corresponds to the active position, the fact that the central part (to which the third flexible element 8, monitored by the position sensor 7*a*, 7*b* of the pulley 7, is connected) of the door 2 arranges itself in the correct active position, for example for closure of the opening A, entails that the lateral ends of the door 2 also are correctly in the active position, for example aligned with said opening A.

Any inclination of the door 2 with respect to the opening A would in fact cause the arrangement of one of its edges in alignment (resting) on an abutment locator of the lower threshold of the opening A. The consequence would be that the opposite edge of the door 2 would be raised with respect to the abutment locator of the lower threshold of the opening A: inevitably, the centerline of the door 2 also would be at least partially raised with respect to the abutment locator of the lower threshold of the opening A and therefore the position sensor 7*a*, 7*b* would not be able to validate closure (since the third flexible element 8 would not have been able to unwind from the respective pulley 7 by the predefined amount, since the lower edge of the door 2 is separated from the lower threshold of the opening A and in particular does not rest on the abutment locator).

More specifically (see FIGS. 1, 2 and 3), the sensor 7*a*, 7*b* comprises a fixed portion 7*a*, which is provided with a specific electric power supply, and a passive movable portion 7*b*, which is integral with the pulley 7 (and therefore can rotate with it). The fixed portion 7*a* is adapted to detect the movable portion 7*b* when they face each other.

In detail, the movable portion 7*b* is connected to a side wall of the pulley 7.

Rotations of the pulley 7 therefore cause continuous and consecutive alignments of the movable portion 7*b* with the fixed portion 7*a*, with the consequent possibility to check any positions that are mutually separated in height by a distance that is substantially a multiple of the circumference of the race of the pulley 7.

If the need arises to check, by means of the sensor 7*a*, 7*b*, also additional positions (heights) of the door 2, it is possible to install additional fixed portions 7*a* with alignments that are different with respect to the one shown in the accompanying figures.

It is further possible to provide the pulley 7 with a second sensor, which is substantially identical to the sensor 7*a*, 7*b*, which comprises a movable portion that is connected integrally to the pulley 7 at a side wall that is opposite to the side wall on which the movable portion 7*b* of the sensor 7*a*, 7*b* is mounted. The second sensor further comprises a fixed portion, which is arranged on the opposite side with respect to the fixed portion 7*b* of the sensor 7*a*, 7*b* relative to the pulley 7 and is adapted to detect the movable portion when they face each other.

By virtue of the described solution and the particular shape of the actuator 3 it is therefore possible to check with certainty that the door 2 is correctly arranged in the active position, for example in a position for closing the opening A.

According to a particular embodiment of unquestionable practical interest in practice and in application, the at least one third idle pulley 7 is associated with an elastic winder 9.

The elastic winder 9 is designed for the elastic forcing of a winding rotation of the respective flexible element 8 on the respective third pulley 7.

The elastic moment that is produced by the elastic winder 9 is such as to induce a winding rotation of the respective flexible element 8 on the respective third pulley 7. This elastic moment ensures that the flexible element 8 is never slack.

However, this elastic moment is smaller than the moment generated by the weight of the door 2 (by means of the respective flexible element 8), which instead induces a rotation for unwinding the respective flexible element 8 from the third pulley 7 (the door 2, by gravity, in fact tends to descend until it rests on the mentioned abutment locator of the threshold of the opening A; the presence of the flexible elements 6 and 8, unwound by a predefined quantity, instead allows to suspend the door 2).

The elastic winder 9 performs a fundamental task, allowing to monitor the height reached by the centerline of the door 2 (to which it is connected), thus providing specific information from which it is possible to detect and deduce any presence of a jamming that causes inclined arrangements of the door 2. If the door 2 jams during descent (and therefore one of its lateral edges abuts against the surface of one of the guiding elements within which the door 2 can slide), the elastic winder 9 in fact indicates the exact height at which the central portion of the door 2 is arranged, assuredly identifying whether said height is the predefined one or not. If the detected height is not the predefined one, one would deduce that a malfunction (for example a jamming) has occurred. It will then be possible, by actuating the pulleys 5, to act on the first and second flexible elements 6 in order to release the door 2 (with respect to the jamming configuration) and restore the ideal alignment conditions.

It is deemed useful to point out that the motorized shaft 4 can be coupled validly to a gearmotor 10 powered by a respective control and management unit.

By means of the control and management unit it is therefore possible to actuate the descent and the rise of the door 2 and also the speed with which this descent and rise are performed.

Upon a jamming of the door 2, the control and management unit (by receiving from the position sensor 7*a*, 7*b* a signal that corresponds to the failed closure of the opening A) can thus actuate a brief winding of any one of the, or of both of the, first and second flexible elements 6 on the respective pulleys 5, which restores the correct alignment of the door 2. Following the brief winding, the unit will then be able to actuate again the unwinding of the first and second flexible elements 6 from the pulleys 5, with consequent descent of the door 2 until the opening A is closed (as verified by means of the position sensor 7*a*, 7*b* of the idle pulley 7).

It is possible to ensure greater regularity and linearity of the movement (sliding) of the door 2 if a respective rigid stem 11 is interposed between each one of the flexible elements 6 and 8 and the respective substantially upper portion of the door 2, having a lower end that is coupled to the door 2 (a coupling with at least one degree of freedom is provided in order to allow the door 2 to rotate with respect to the stems 11 to which it is connected, a condition that reduces considerably the risk of jamming of the door 2) and an upper end which is coupled to an end portion of the corresponding flexible element 6, 8.

Furthermore, the stem 11 allows the operators and in particular the installation technicians to perform operations for adjusting the position of the door 2 in a simple manner. In particular, it is possible to provide for the presence of threaded portions (or other adjustable couplings) in order to perform adjustments that allow to arrange the door 2 with the lower edge aligned horizontally, so as to be in the exact positions of interest in application once the first and second flexible elements 6 have been unwound.

In order to allow easy adjustment at the installation steps of the closure apparatus 1 on the industrial machine, it is possible to interpose between the upper end of each stem 11 and the corresponding end portion of the corresponding flexible element 6, 8, threaded interconnection assemblies 12 for the adjustment of their mutual distance.

In this manner it is possible to adjust the apparatus 1 at installation time (by making the detection of the position sensor 7*a*, 7*b* correspond precisely to a correct and assured closure of the opening A by means of the door 2).

By means of the threaded interconnection assemblies 12 it is further possible to perform periodic adjustments that take into account thermal expansions and/or elongations caused by mechanical hysteresis phenomena.

It is specified that each one of the flexible elements 6, 8 can be of the type preferably chosen from a cable, a rope, a belt, a chain and the like.

According to an embodiment that is of assured interest in application, the motorized shaft 4 and the pulleys 5 and 7 of the actuator 3 are arranged outside the industrial machine.

Advantageously, the sensor 7*a*, 7*b* is arranged outside the industrial machine, for example externally to a sterilization tunnel.

It is therefore pointed out that the motorized shaft 4, the pulleys 5 and 7 and the sensor 7*a*, 7*b* are never subjected to the onerous thermal conditions that instead occur inside the industrial machine.

It is deemed necessary to specify that, with particular reference to a constructive solution of unquestionable practical interest, the gearmotor 10, the shaft 4 and the pulleys 5 and 7 of the actuator 3 are integral with a supporting plate 13, which in turn is rigidly coupled and superimposed on an upper wall of the industrial machine.

The plate 13 and the upper wall of the industrial machine comprise respective holes 14 for the entry and sliding of the flexible elements 6 and 8 within the machine.

From the point of view of actuation (with reference to one of the possible constructive solutions that can be performed by applying the teachings of the present disclosure), it is specified that, in addition or as an alternative to the detection of the complete closure position of the opening A on the part of the door 2 (which might also occur in a condition in which it does not abut against a respective locator), it might be useful to control an intermediate position, which is arranged between the active position and the inactive position.

For example, in the case of an opening A that is interposed between a sterilization tunnel and a filling station, which are detachably connected by a movable bridge, it may be advantageous to control an intermediate position in which the door 2 is located directly above the bridge. In this intermediate position also, the door 2 does not necessarily lie in abutment against a respective locator and indeed it is customary for it to hang from the respective first and second flexible elements 6. In the intermediate position, the door 2 is designed to prevent access to the tunnel on the part of an operator, but it allows in any case the tunnel to operate, in particular in an initial work step, in which the containers are loaded into the sterilization tunnel, but no container exits from the tunnel (a step that can last even more than one hour): during this initial work step, the operator can perform maintenance operations on the downstream filling station, without having the possibility to enter the tunnel with his/her hands, thus remaining in safe conditions.

Advantageously, the present disclosure has the advantage of solving the problems described earlier, proposing a closure apparatus for openings for access to industrial machines that allows to check the correct arrangement of the door with respect to predefined positions of interest in application.

Positively, the closure apparatus 1 for openings A for access to industrial machines can further ensure the complete closure of the opening A.

These results are achieved by virtue of the detection performed with the position sensor 7*a*, 7*b* of the idle pulley 7, which, by being in a substantially central position, confirms the correct placement of the door 2 with respect to a predefined position, for example with respect to an abutment locator of the lower threshold of the opening A.

More generally, the position sensor 7*a*, 7*b* confirms the correct placement of a lower and central edge of the door 2 with respect to a nominal position (which can correspond to a position of the door 2 for total or partial closure of the opening A), which allows to infer whether the entire door 2 is in the correct position. In practice, if the pulleys 5 are turned in order to unwind the first and second flexible elements 6 by the quantity that exactly corresponds to having the door 2 in the (total or partial) closure position, if the position sensor 7*a*, 7*b* does not detect the correct nominal position of the lower and central edge of the door 2, this would mean that the door 2 has jammed and that, for example, the opening A is not closed correctly.

Validly, the closure apparatus 1 is suitable to tolerate very high operating temperatures. The position sensor 7*a*, 7*b* and the actuator 3, the only components that might be damaged by high temperatures, are in fact arranged on the outside of the industrial machine, for example on the outside of a sterilization tunnel.

Usefully, the closure apparatus 1 is of a type and has an operating mode that are substantially different from those of closure apparatuses of the known type.

Conveniently, the closure apparatus 1 is relatively simple to provide in practice and can be provided with modest costs: these characteristics make this technical solution safe in application.

The disclosure thus conceived is susceptible of numerous modifications and variations, all of which are within the scope of the appended claims; all the details may further be replaced with other technically equivalent elements.

In the exemplary embodiments shown, individual characteristics, given in relation to specific examples, may actually be interchanged with other different characteristics that exist in other exemplary embodiments.

In practice, the materials used, as well as the dimensions, may be any according to the requirements and the state of the art.

The disclosures in Italian Patent Application No. 102016000021524 (UB2016A001218) from which this application claims priority are incorporated herein by reference.

The invention claimed is:

1. A closure apparatus for openings accesses to industrial machines, the closure apparatus comprising: a movable door and an actuator adapted to move the movable door between an active closure position for closing an opening, and an inactive position for noninterference with said opening, at which said movable door substantially clear said opening, wherein said actuator comprises a motorized shaft which supports, at its ends, at least two mutually opposite pulleys driven by said motorized shaft and adapted to wind respectively first and second flexible elements connected to respective substantially upper and external portions of said movable door, said actuator further comprising, substantially at an intermediate section of said motorized shaft, at least one third idle pulley idly mounted on said motorized shaft for winding at least one third flexible element connected to a substantially upper and central portion of said movable door, said at least one third idle pulley being provided with at least one position sensor for detecting an unrolling of said at least one third flexible element, which corresponds to the active closure position of said opening.

2. The closure apparatus according to claim 1, wherein said at least one third idle pulley is associated with an elastic winder to force elastically a winding rotation of said at least one third flexible element on the at least one third idle pulley, said elastic winder generating a moment which induces a rotation for winding said at least one third flexible element on the at least one third idle pulley, said moment being smaller than the moment generated by the weight of said movable door, which induces a rotation for unwinding said at least one third flexible element from said at least one third idle pulley.

3. The closure apparatus according to claim 1, wherein said motorized shaft is coupled to a gearmotor powered by a respective control and management unit.

4. The closure apparatus according to claim 3, wherein said gearmotor, said motorized shaft and said mutually opposite pulleys and said at least one third idle of said actuator are associated to a supporting plate rigidly coupled and superimposed on an upper wall of an industrial machine, said supporting plate and said upper wall of said industrial machine comprising respective holes for entry and sliding of said first and second flexible elements and at least one third flexible element within said industrial machine.

5. The closure apparatus according to claim 1, wherein respective rigid stems are interposed between said first, second and at least one third flexible elements and the respective substantially upper and external portions and upper and central portion of said movable door.

6. The closure apparatus according to claim 5, wherein threaded interconnection assemblies are interposed each of said respective rigid stems and the corresponding end portions of said first, second and at least one third flexible elements, respectively.

7. The closure apparatus according to claim 1, wherein said first, second, and at least one third flexible elements are of the type among cable, rope, belt and chain.

8. The closure apparatus according to claim 1, wherein said motorized shaft and said mutually opposite pulleys and said at least one third idle of said actuator are arranged outside an industrial machine.

9. The closure apparatus according to claim 1, wherein said at least one position sensor comprises a fixed portion provided with electric power, and a movable portion integral with the at least one third idle pulley, the fixed portion being adapted to detect the movable portion when they face each other.

10. The closure apparatus according to claim 9, wherein the movable portion is connected to, and movable with, a side wall of the at least one third idle pulley.

11. A machine comprising a sterilization tunnel adapted to sterilize a plurality of containers and a filling station adapted to fill containers with a pharmaceutical product, an access opening being interposed between the sterilization tunnel and the filling station, and further comprising a closure apparatus for said access opening according to claim 1.

12. The machine according to claim 11, wherein said at least one position sensor is arranged outside of said sterilization tunnel.

* * * * *